US005322128A

United States Patent [19]

Bernhardt

[11] Patent Number: 5,322,128

[45] Date of Patent: Jun. 21, 1994

[54] METHOD OF FORMING WELL REGIONS

[75] Inventor: Bruno Bernhardt, Reutlingen, Fed. Rep. of Germany

[73] Assignee: IEG Industrie-Engineering GmbH, Reutlingen, Fed. Rep. of Germany

[21] Appl. No.: 33,138

[22] Filed: Mar. 18, 1993

[30] Foreign Application Priority Data

Mar. 23, 1992 [DE] Fed. Rep. of Germany ..... 4209329

[51] Int. Cl.[5] ..... E21B 43/00

[52] U.S. Cl. ..... 166/313; 166/245

[58] Field of Search ..... 166/313, 369, 245, 305.1, 166/306, 268

[56] References Cited

U.S. PATENT DOCUMENTS

| | | | |
|---|---|---|---|
| 4,254,831 | 10/1981 | Nuzman . | |
| 4,398,602 | 8/1983 | Anderson | 166/245 |
| 4,465,136 | 8/1984 | Troutman | 166/245 X |
| 4,522,260 | 6/1985 | Wolcott, Jr. | 166/245 |
| 4,637,468 | 1/1987 | Derrick | 166/313 X |
| 4,651,825 | 3/1987 | Wilson | 166/245 |
| 4,669,542 | 2/1987 | Venkatesan . | |
| 4,754,808 | 7/1988 | Harmon et al. | 166/245 |

FOREIGN PATENT DOCUMENTS

| | | |
|---|---|---|
| 324233 | 8/1975 | Austria . |
| 389135 | 10/1989 | Austria . |
| 71479 | 10/1893 | Fed. Rep. of Germany . |
| 511302 | 10/1930 | Fed. Rep. of Germany . |
| 3612468 | 10/1987 | Fed. Rep. of Germany . |
| 578655 | 8/1976 | Switzerland . |
| 1719563 | 3/1992 | U.S.S.R. . |

*Primary Examiner*—Thuy M. Bui
*Attorney, Agent, or Firm*—Michael J. Striker

[57] ABSTRACT

A method of forming well regions for improving well efficiency is performed by forming a first bore hole to a ground region having a relatively good liquid guiding properties, forming at least one second bore hole near the first bore hole to the same ground region, loosening and at least partially washing out components of a ground material surrounding the bore holes in the ground region by at least one of pumping in or aspirating liquid into or out at least one of the bore holes, and introducing into at least one of the bore holes after removing a bore tube, a well tube so that permeable well tube regions are located at the height of the washed ground region surrounding the bore holes.

7 Claims, 2 Drawing Sheets

METHOD OF FORMING WELL REGIONS

BACKGROUND OF THE INVENTION

The present invention relates to a method of forming well regions for improving the efficiency of wells.

Wells of all types have a limited service life, since over time they are clogged with entrained sediments or with contamination in the liquid entry regions. Since well bore holes are sunk with a relatively great diameter for receiving the well tube with a surrounding gravel filter layer, the production of the wells is relatively expensive and a short service life of such wells is a substantial disadvantage. Due to the surrounding gravel filter layer the clogging of the well tube is first delayed. However, it has been recognized that the addition of sediments to the gravel filter layer contributes to the above described phenomenon with the reduction of the inflow speed of the liquid into the well shaft due to the increasing inflow resistance.

SUMMARY OF THE INVENTION

Accordingly, it is an object of the present invention to provide a method of forming well regions, which avoids the disadvantages of the prior art.

More particularly, it is an object of the present invention to form well bore holes so that their service life is significantly increased.

In keeping with these objects and with others which will become apparent hereinafter, one feature of the present invention resides, briefly stated, in a method of forming well regions, in accordance which includes forming a first bore hole to a ground region which has relatively good guiding properties as can be determined by preliminary research, forming at least one second bore hole near the first bore hole in the same ground region, loosening and at least partially washing out components of ground material surrounding the bore holes in the ground region by pressing in and/or aspirating liquid in or out at least one of the two bore holes, in some cases driving the bore hole deeper into at least one second ground region which is known as having good liquid properties and repeating the immediately preceding step, later on after removing the boring tools introducing a well tube into at least one of the formed bore holes so that the permeable well tube regions are located at the height of the rinsed bore hole surrounding region.

When the method is performed in accordance with the present invention, a high flow speed of the liquid flowing into the well tube is produced in an aspiration region of a well. The braking which results from a different density of conventional gravel coating is dispensed with. Thereby a clogging of the well tube surrounding area is substantially reduced as compared with conventional wells.

With a method in accordance with the present invention, depending on the structure of the predetermined water guiding ground layers, a more or less large-surface horizontal unclogging is obtained also in different ground layers which are spaced from one another in a vertical direction. Therefore the utilization of the inventive method is especially suitable for well arrangements for cleaning of contaminated ground regions and ground water in situ where in the ground a liquid flow between well tube wall regions spaced vertically from one another is positively produced.

Especially great rinsed ground regions can be filled advantageously and in accordance with an inventive feature, at least partially with particulate, washable-in filling bodies which have size and material properties adapted to the use of the corresponding wells. For cleaning wells as well as for drinking water wells, bodies produced for example of ceramic material and having great outer surfaces can be for example selected as filling bodies since they are suitable for the adsorption of gases and dissolved matter and/or for settling of microorganisms. Also conventional filter bodies can be washed-in as filling bodies.

The important method step of washing out of regions of the liquid guiding ground layers can be improved when several additional bore holes are provided around the first bore hole at a distance allowing a washing out, and the central first bore hole is later used as a well bore hole. A distance which allows a washing out is in the individual case a distance to be selected, with which by pressing in the outer bore hole in the region of the central bore hole which serves as a return bore hole, due to the provided pressure difference the liquid flow is so intense that between the bore holes connecting passages are provided and around the central bore hole a washing out of ground material is achieved. During a washing out step a bore tube can be progressively moved for guiding the pressure liquid and the loosened solid matter.

Conducted research has shown that during use of the method in accordance with the present invention, in many cases the generally required encasing of the well tube with a gravel filter layer can be dispensed with. It is practically possible to provide a natural well without a flow hindrance by a filter at the introduction and withdrawal points. This means that the well bore holes can be driven with a substantially smaller diameter and in correspondingly cheaper way. Where it is not possible to dispense with an outer gravel filter encasing of the well tube, in the utilized method the bore hole selected as a well hole must be drilled before the rinsing of at least one surrounding region and before the insertion of a well tube to a greater diameter at least to the rinsed region. The subsequent graveling of the well bore hole is then performed after the central arrangement of the well tube in the well bore hole.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
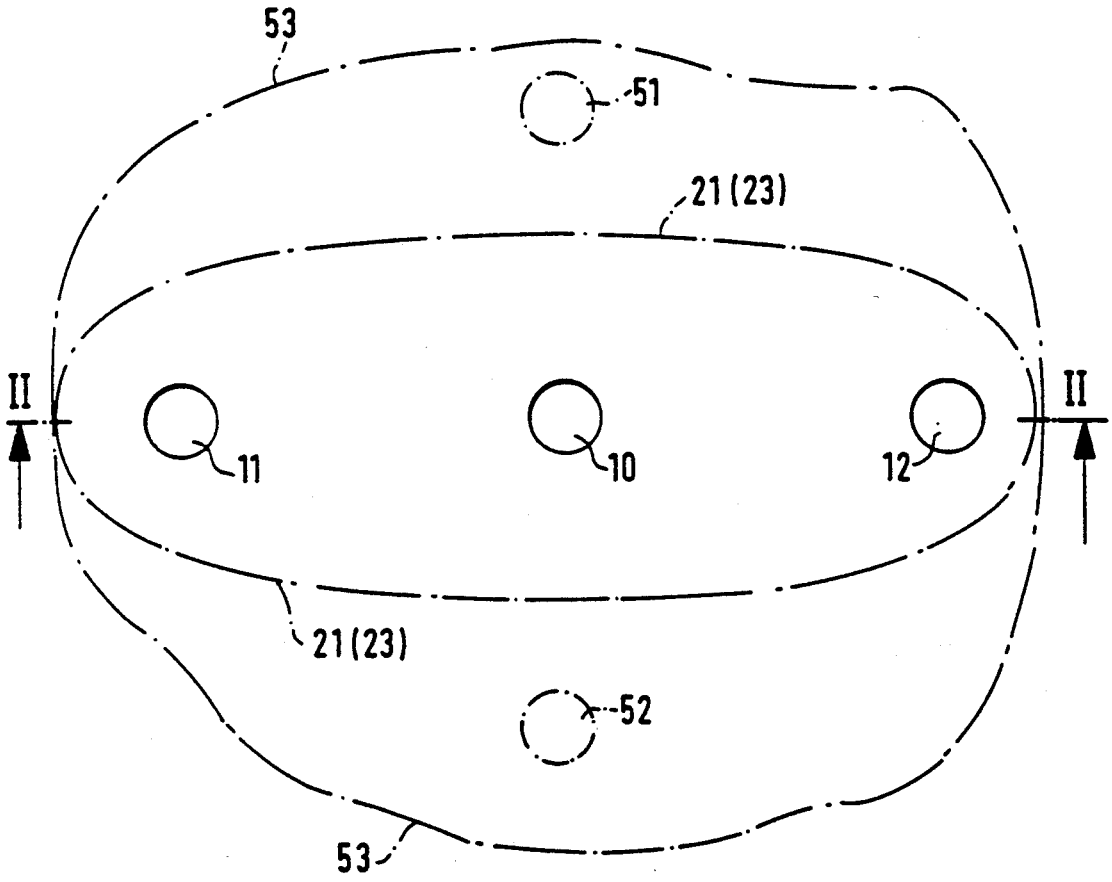
FIG. 1 is a plan view of bore holes of a well arrangement.
Figure 2:
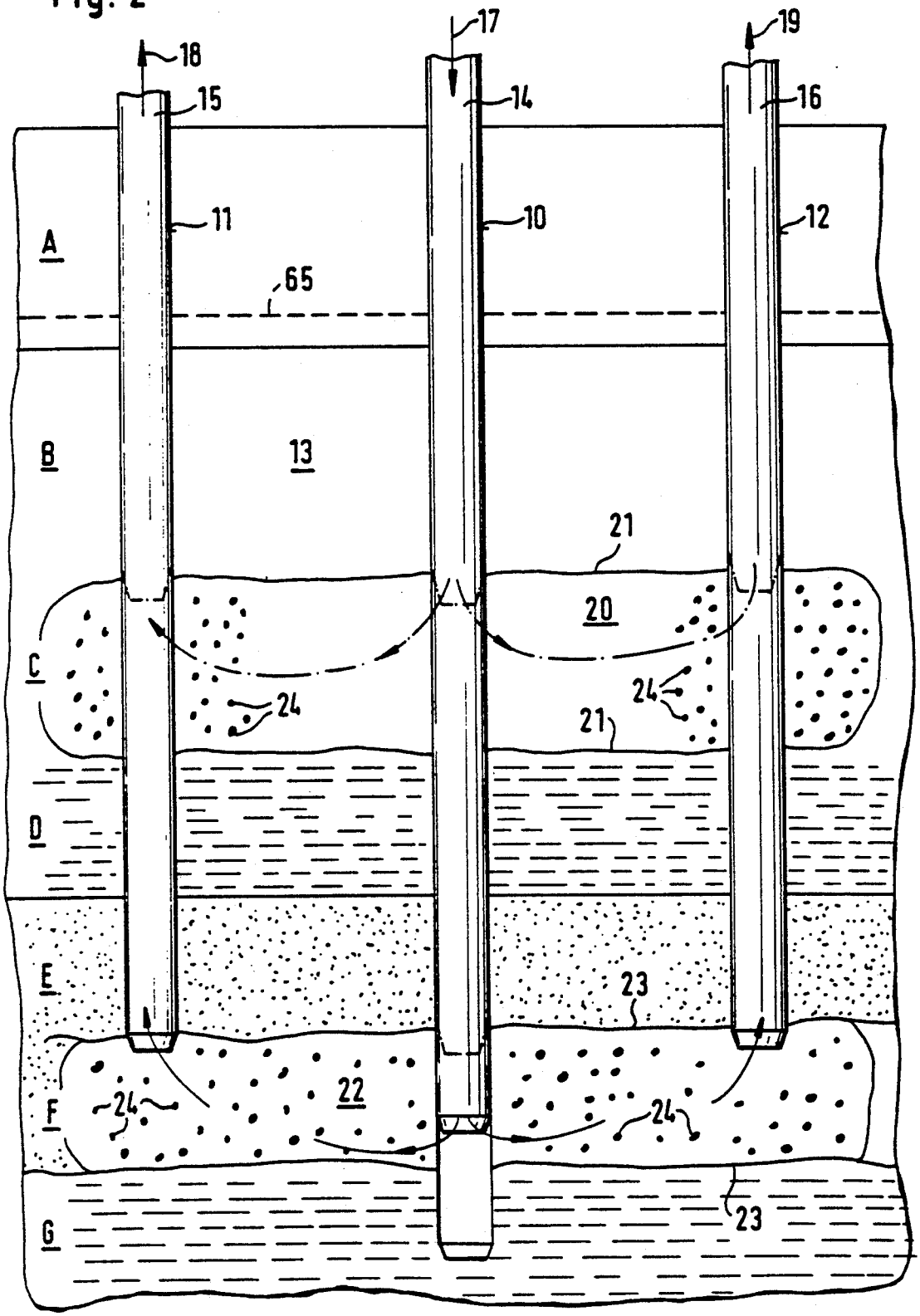
FIG. 2 is a view showing a vertical section of the well arrangement taken along the line II—II in FIG. 1.

In accordance with a method of forming well regions of the present invention as shown in FIGS. 1 and 2, a central bore hole 10 and two additional bore holes 11 and 12 located at both sides of the central bore hole 10 are produced in a ground 13. For this purpose bore tubes 14, 15 and 16 can be utilized. They are screwed or rammed into the ground and execute the method of the invention after removing of the bore cores. Bore tubes can later perform the function of well tubes. The bore core provides the information about the properties of different bored ground layers identified with reference letters A–F in FIG. 2. In the produced bore holes 10–12, after removing the bore cores from the bore tubes 14–16, also not shown measuring probes can be introduced. Therefore the ground water permeability of the individual ground layers A–F can be determined, for example by ground water measuring probes.

In the well arrangement selected as an example here, two ground layers which are spaced from one another in the vertical direction and are relatively water permeable are of interest. These are the ground layers C and F which are mainly composed from sediment layers of sand and gravel.

The method starts with the stepwise driving of the bore hole 10. When the removed bore core shows that a first good ground water-permeable ground layer, here the layer C is reached, both bore holes 11 and 12 are also driven to the same height. When it is recognized that the ground layer C is provided with the openings and deals not only with a small sand and gravel filler, the washing out of the ground layer C in the region of the driven bore holes is started. Water is pumped under high pressure into the central bore tube 14 as shown in FIG. 2 by the downwardly directed arrow 17. Simultaneously ground water together with the sand and gravel material released by the pressure water 17 pumped into the central open bore hole 10, is aspirated through both bore tubes 15 and 16. This is shown by the upwardly directed arrows 18 and 19. In this method step the pressure water introduction can be alternating between three bore tubes 14, 15, 16 so that the loosening of the sediment materials is facilitated. The bore tube which introduces the pressure water is displaced during the pressure water introduction over the height of the ground layer C. Finally, by this washing out a more or less homogeneous hollow chamber 20 is formed. Its limits are identified in FIGS. 1 and 2 by a dash-dot or solid line 21.

Then the central bore hole 10 is driven further with the central bore tube 14, until it reaches the second well water-guiding layer F. After the driving of both bore holes 11 and 12 further to the ground layer F the above described washing out step is repeated and a second more or less homogeneous hollow chamber 22 is formed with the limiting line 23.

In the shown embodiment the hollow chambers 20 and 22 are subsequently filled with grainy ceramic material having high porous surface, which is washed in with water into the hollow chambers. The ceramic grains can be provided with ground-sanitizing microorganisms.

In FIG. 1 two additional bore holes 51 and 52 are identified with dash-dot lines. During performing of the method greater hollow chambers which are concentric relative to the central bore hole 10 can be washed out with these additional bore holes. Its border is identified with a dash-dot line 53. In well arrangements for withdrawing drinking water as a rule only one well water guiding bottom layer is bored through. In this water layer the washing out and, depending on the ground property a subsequent support and filter filling is provided. A subsequent boring of a bore hole selected for water transportation can be dispensed with as a rule, and this makes the well boring substantially less expensive. The diameter of the utilized well tube is adjusted in correspondence with the bore tube diameter.

It will be understood that each of the elements described above, or two or more together, may also find a useful application in other types of methods differing from the types described above.

While the invention has been illustrated and described as embodied in a method of forming well regions for improving well efficiency, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of forming well regions for improving well efficiency, comprising the steps of forming a first bore hole to a ground region having a relatively good liquid guiding properties; forming at least one second bore hole near the first bore hole to the same ground region; loosening and at least partially washing out components of a ground material surrounding the bore holes in the ground region by at least one of pumping in or aspirating liquid into or out at least one of the bore holes; and introducing into at least one of the bore holes after removing a bore tube, a well tube so that permeable well tube regions are located at the height of the washed ground region surrounding the bore holes.

2. A method as defined in claim 1; and further comprising the steps of driving deeper the bore holes to at least one second ground region with relatively good liquid guiding properties; and again loosening and at least partially washing out components of a ground material surrounding the bore holes in the ground region by at least one of pumping in or aspirating liquid into or out at least one of the bore holes.

3. A method as defined in claim 1; and further comprising the steps of at least partially filling the washed ground region which surround the bore holes with particulate, washable-in filling bodies.

4. A method as defined in claim 3, wherein said filing bodies are composed of grains of ceramic material having a great surface for adsorption of gases and dissolved matter and/or settling of microorganisms.

5. A method as defined in claim 3, wherein said filling of the filling bodies includes washing-in of conventional filling bodies.

6. A method as defined in claim 1; and further comprising the steps of providing several additional bore holes around the first bore hole located at a distance permitting a washing out; and utilizing said first bore hole as a well bore hole.

7. A method as defined in claim 1; and further comprising the step of moving a bore tube during the washing out for supplying or withdrawing a pressurized liquid.

* * * * *